US007971517B2

(12) United States Patent
Eagleston et al.

(10) Patent No.: US 7,971,517 B2
(45) Date of Patent: Jul. 5, 2011

(54) GUN RECOIL

(75) Inventors: David Andrew Eagleston, Barrow-in-Furness (GB); Stephen Wildgoose, Ulverston (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 12/291,028

(22) Filed: Dec. 16, 2008

(65) Prior Publication Data

US 2010/0011951 A1 Jan. 21, 2010

(30) Foreign Application Priority Data

Dec. 21, 2007 (GB) ..... 0725247.1

(51) Int. Cl.
*F41A 25/22* (2006.01)

(52) U.S. Cl. ..... 89/37.14; 89/43.01

(58) Field of Classification Search ..... 89/37.14, 89/43.01

See application file for complete search history.

(56) References Cited

U.S. PATENT DOCUMENTS

| | | | | |
|---|---|---|---|---|
| 442,919 | A * | 12/1890 | Schneider | 89/43.01 |
| 1,754,943 | A * | 4/1930 | Hammar | 89/43.01 |
| 3,026,777 | A | 3/1962 | Wooderson, III | |
| 4,269,109 | A | 5/1981 | Stoner | |
| 4,524,671 | A * | 6/1985 | Bender et al. | 89/14.05 |
| 4,624,346 | A * | 11/1986 | Katz | 188/282 |
| 4,690,032 | A * | 9/1987 | Stoner | 89/43.01 |
| 4,867,040 | A * | 9/1989 | Barrett | 89/172 |
| 6,347,568 | B1 | 2/2002 | Soulaigre | |
| 2007/0256345 | A1 * | 11/2007 | Hall et al. | 42/76.1 |

FOREIGN PATENT DOCUMENTS

| | | |
|---|---|---|
| GB | 2 111 656 A | 7/1983 |
| GB | 2 237 622 A | 5/1991 |
| WO | WO 2007/139447 A1 | 12/2007 |

* cited by examiner

*Primary Examiner* — Stephen M Johnson
(74) *Attorney, Agent, or Firm* — Scully, Scott, Murphy & Presser, P.C.

(57) ABSTRACT

A gun comprising: a generally tubular barrel defining a barrel axis and having an external barrel surface about the perimeter of the tubular barrel a cradle having a cradle bore for accommodating a section of the barrel wherein the barrel is slidably mounted in the cradle bore such that the barrel can move relative to the cradle along the barrel axis across a range of barrel positions and wherein an interface defined by the slidable contact between external barrel surface and the cradle bore—i) prevents rotation of the barrel relative to the cradle about the barrel axis; and ii) is maintained at a single section of the cradle over the entire range of barrel positions.

5 Claims, 3 Drawing Sheets

GUN RECOIL

FIELD OF THE INVENTION

The following invention relates to a gun and in particular, a field gun.

BACKGROUND OF THE INVENTION

Field guns are typically provided with a mechanism to accommodate the high recoil forces generated when firing a round. One known recoil accommodation mechanism involves slidably mounting the barrel within a cradle so that the barrel can slide along its axes relative to the cradle. When a round is fired from the barrel, the barrel can counteract the momentum of the fired projectile by sliding backwards from a firing position (equilibrium position). This reduces the peak stresses induced in the field gun. The barrel can then return to its firing position so the field gun is ready for firing another round.

In addition to the recoil force a rifled barrel will also be subjected to a firing torque as a spin is imparted to the round by the rifling.

A gun employing such a known recoil accommodating mechanism is the M777 155 mm Lightweight Field Howitzer (M777). FIG. 1 shows an M777 cradle. In the M777, the breech end of the barrel is provided with at least one radially protruding lug. Each lug is disposed within a runner 202 that is attached to the sides of the cradle 200. The runner 202 extends away from the breech region 204 to a region 206 next to the point of maximum barrel recoil. The runner 202 serves to channel the lug (and hence the barrel) during recoil, and also serves to oppose rotation of the barrel that might be induced by the firing torque.

However, because this arrangement requires that the runners 202 (and hence the cradle 200) extend to the backmost portion of the recoil range, it restricts operator access to the breech. This increases reload time.

It is therefore an object of the invention to provide an interface between the barrel and the cradle that is not only resistant to firing torque but also leaves the breech readily accessible for loading by an operator.

SUMMARY OF THE INVENTION

Accordingly there is provided a gun comprising: a barrel defining a barrel axis and having an external barrel surface about the perimeter of the barrel; a cradle having a cradle bore for accommodating a section of the barrel, wherein the barrel is slidably mounted in the cradle bore such that the barrel can move relative to the cradle along the barrel axis across a range of barrel positions, and wherein an interface defined by the slidable contact between the external barrel surface and the cradle bore—i) prevents rotation of the barrel relative to the cradle about the barrel axis; and ii) is maintained at a section of the cradle bore over the entire range of barrel positions.

Advantageously this provides a means that simultaneously channels the recoil of the barrel and opposes the firing torque and yet leaves the breech accessible to operators.

Preferably the interface is of a non-circular cross-section and in particular preference, the interface is of a regular polygonal cross-section.

A regular polygonal cross-sectioned barrel (e.g. octagonal) is advantageously interchangeable with a circular cross-section barrel insofar as for an equivalent diameter, there exist only negligible differences in strength, with no significant difference in weight.

DETAILED DESCRIPTION OF THE INVENTION

A particular embodiment of the invention shall now be described with reference to the following figures, of which:

Figure 1:
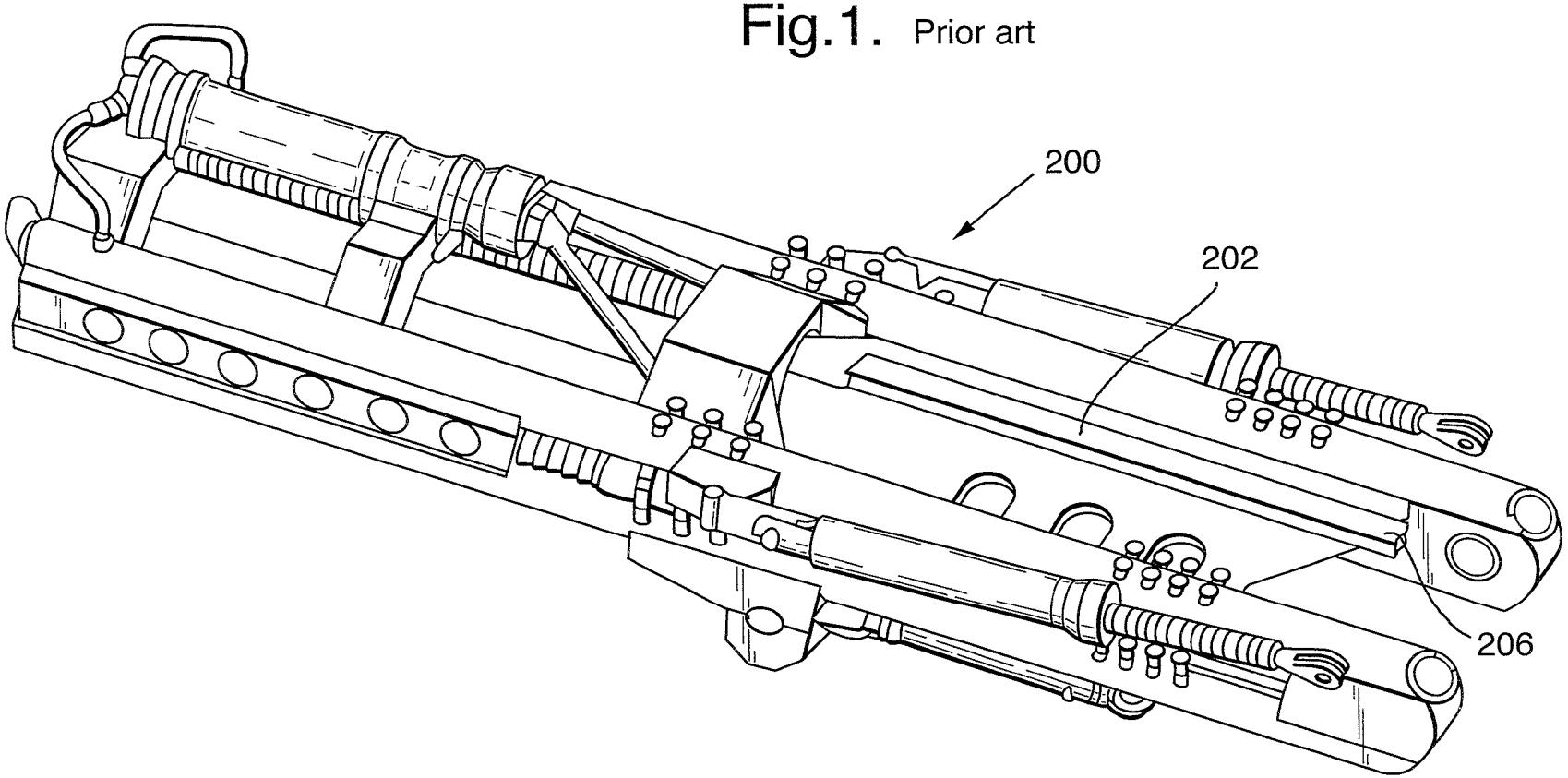
Fig.1. Prior art
FIG. 1 shows a geometric view of a prior art gun cradle.
Figure 2:
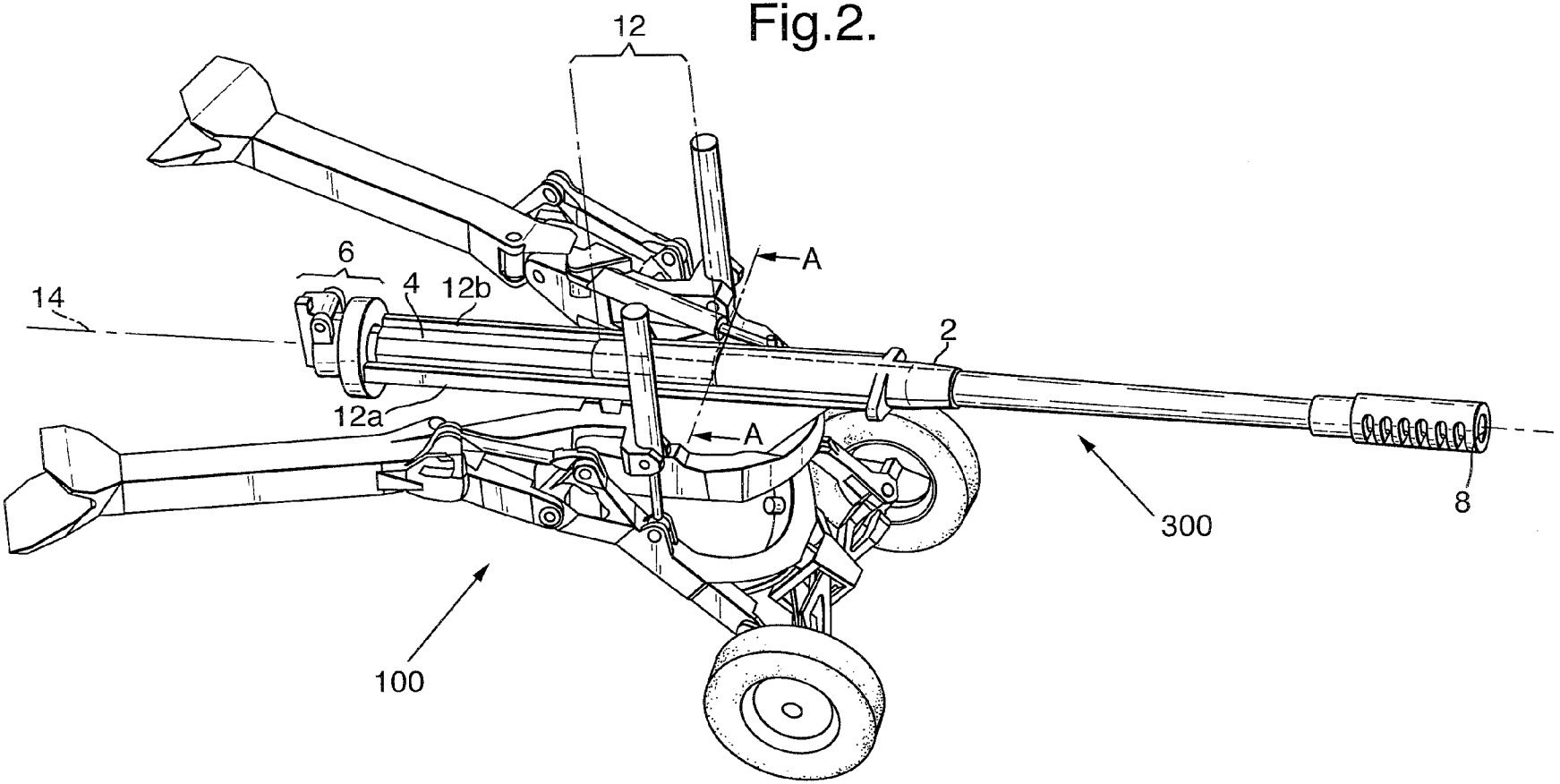
FIG. 2 shows a geometric view of an exemplary field gun with the barrel at a point of maximum recoil.

Referring to FIG. 2, a howitzer (alternatively referred to as a field gun) 100 is shown. The howitzer 100 is provided with a barrel 300, a cradle 2 and hydraulic dampers 12*a* and 12*b*. The barrel 300 is slidably mounted within the cradle 2 so that, relative to the cradle 2, the barrel 300 can slide along a barrel axis 14 defined by the barrel 300. The cradle 2 is generally tubular and as such defines a bore into which the barrel 300 is coaxially housed. The barrel 300 has rifling along a bore 8.

A first and second elongate hydraulic damper 12*a* and 12*b* are situated parallel to the barrel axis 14, fixed at one end to the cradle 2, and at the other end to the breech end 6 of the barrel 300.

The hydraulic dampers 12*a*, 12*b* are in the form of an extensible piston and cylinder assembly. These dampers 12*a*, 12*b* are arranged so that when the barrel 300 is in a fully recoiled position (as shown in FIG. 2) the damper tends towards being fully extended. When the barrel 300 is in its firing position, the piston is retracted into the cylinder and thus the dampers 12*a*, 12*b* tend towards being minimally extended.

Figure 3:
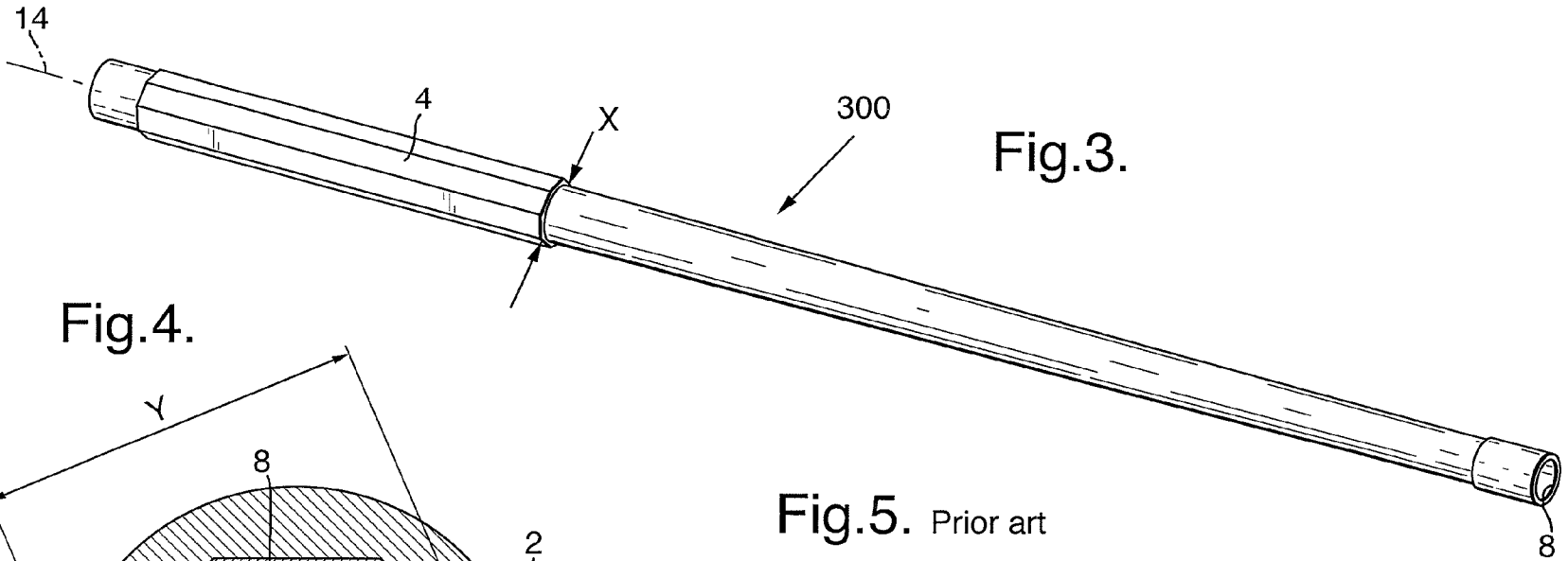
FIG. 3 shows a geometric view of a gun barrel as may be used in the field gun on FIG. 2, the barrel having an external octagonal section towards the breech end.
Figure 4:
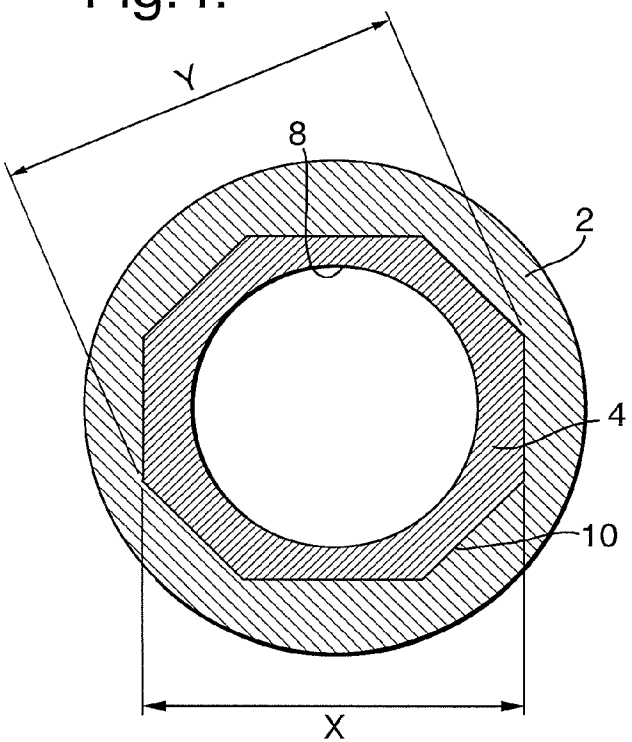
FIG. 4 shows a cross section through the gun of FIG. 1 through line AA.

Referring additionally to FIGS. 3 and 4, the barrel 300 can be seen to have a collar section 4 towards a breech end 6. The collar section 4 has externally the form of an octagonal extrusion and has a minimum diameter X greater than the greatest diameter of the cylindrical sections of the barrel. The collar section 4 is intended to mate with an internal surface of the cradle 2 to give an interface 10, as is clearly depicted in FIG. 4. This interface is maintained at a single section of the cradle bore over the entire range of barrel positions.

From FIG. 2 it can be seen that even when the barrel 300 is in its position of greatest recoil, a section of the interface 10 occurs between the collar 4 of the barrel 300 and a section 12 of the cradle 2. When the barrel is in the equilibrium position, cradle section 12 still maintains the interface 10, but in the equilibrium position a different barrel section mates with the cradle section 12. The section 12 of the cradle 2 which provides this maximum recoil interface therefore maintains the interface 10 over the entire range of barrel positions.

In operation, the interface 10, which defines a surface having the form of an octagonal extrusion with constant cross-section, allows the barrel to slide through the cradle 2 along the barrel axis 14 over a range of barrel positions. Slide bearings (not shown) for example can be provided to facilitate such sliding movement. Such sliding would contribute to the recoil accommodation mechanism of the gun. The interface 10 also acts to prevent the barrel 300 from rotating about the barrel axis 14 relative to the cradle 2; it is non-circular and so external surfaces of the barrel would abut internal surfaces of the cradle at the instant that the barrel attempts to rotate. Firing torque is therefore transferred from the barrel to the cradle and on to the whole field gun. Relative to the barrel, the field gun has a large inertia and thus any induced twist is attenuated.

Figure 5:
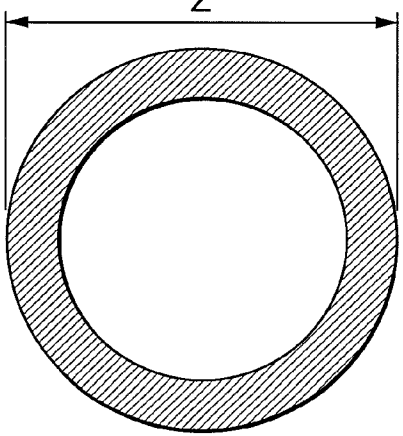
Fig.5. Prior art
FIG. 5 shows a cross section through a cylindrical prior art gun barrel, the gun barrel is of the same calibre as the barrel in FIG. 4.

It has been determined, through experimentation undertaken by the applicant, that barrel sections with octagonal external cross-sections (having minimum diameter X and a maximum diameter Y) and circular internal cross-sections (referred to from now onwards as an octagonal barrel) are strong enough to replace annular cross-sectioned barrel sections (such as that shown in FIG. 5) provided that the mean diameter of the octagonal barrel is equal to the outer diameter, Z, of the annular barrel. That is to say that provided:

$(X+Y)*0.5=Z$, where both barrels have the same calibre, the peak stresses due to internal firing pressure and rifling sheer differ by a negligible amount. Values of Z for various annular barrels would be known to the skilled man.

The exact dimensions of the barrel, and for that matter the materials from which the barrel is made, will be determined according to the desired length of service and calibre of ammunition. The choice of an octagonal section over a circular cross-section does not appreciably alter the weight of the howitzer.

Possible materials from which the barrel could be made include steel alloys.

Whilst an octagonal interface has been described above, this invention is in no way limited to this shape. Any other non-circular shape such as ellipses, regular polygons, irregular polygons, would also be within the scope of the invention.

A further variant within the scope of the invention occurs if the collar 4 of the barrel is not of a constant external cross-section along its length but is provided with lateral ribs for further facilitating the sliding mechanism.

Other variants would be obvious to the man skilled in the art.

The invention claimed is:

1. A gun, comprising:

a barrel defining a barrel axis and having an external barrel surface about the perimeter of the barrel, the external barrel surface including a collar section extending along a length of the barrel;

a cradle having a cradle bore for accommodating a section of the barrel wherein the barrel is slidably mounted in the cradle bore such that the barrel can move relative to the cradle along the barrel axis across a range of barrel positions; and an interface having a polygonal cross-section, the interface being defined by the slidable contact between the collar section of the external barrel surface and the cradle, wherein the interface:

i) prevents rotation of the barrel relative to the cradle about the barrel axis;

ii) is maintained at a section of the cradle over the entire range of barrel positions;

iii) provides slidable contact at all points of the interface; and iv) is maintained over the entire range of barrel positions.

2. A gun according to claim 1 wherein the polygonal cross-section is in the form of a regular polygon.

3. A gun according to claim 2 wherein the polygonal cross-section is octagonal.

4. A gun according to anyone of the preceding claims wherein the interface is of constant cross-section along the section of the barrel to which the cradle is peripheral.

5. A field gun, comprising:

a barrel configured for the field gun, the barrel defining a barrel axis and having an external barrel surface about the perimeter of the barrel, the external barrel surface including a collar section extending along a length of the barrel;

a cradle configured for the field gun, the cradle having a cradle bore for accommodating a section of the barrel wherein the barrel is slidably mounted in the cradle bore such that the barrel can move relative to the cradle along the barrel axis across a range of barrel positions; and an interface having a polygonal cross-section, the interface being defined by the slidable contact between the collar section of the external barrel surface and the cradle, wherein the interface:

i) prevents rotation of the barrel relative to the cradle about the barrel axis;

ii) is maintained at a section of the cradle over the entire range of barrel positions;

iii) provides slidable contact at all points of the interface; and iv) is maintained over the entire range of barrel positions.

* * * * *